US008499480B2

(12) United States Patent
Schlasinger

(10) Patent No.: US 8,499,480 B2
(45) Date of Patent: Aug. 6, 2013

(54) ELECTROSTATICALLY MOUNTED DISPLAY SYSTEM FOR MAGNETIC TOKENS

(75) Inventor: Annette Schlasinger, Minnetonka, MN (US)

(73) Assignee: MGI Companies, Inc., Minnetonka, MN (US)

( * ) Notice: Subject to any disclaimer, the term of this patent is extended or adjusted under 35 U.S.C. 154(b) by 201 days.

(21) Appl. No.: 12/776,398

(22) Filed: May 9, 2010

(65) Prior Publication Data

US 2011/0271570 A1 Nov. 10, 2011

(51) Int. Cl.
*G09F 7/04* (2006.01)

(52) U.S. Cl.
USPC ..... 40/600; 434/134; 40/621

(58) Field of Classification Search
USPC ..... 40/594, 600, 620, 621; 434/73, 134; 273/239, 157 R
See application file for complete search history.

(56) References Cited

U.S. PATENT DOCUMENTS

| | | | | |
|---|---|---|---|---|
| 4,652,239 | A * | 3/1987 | Brimberg | 434/80 |
| 4,674,752 | A * | 6/1987 | Brothers | 273/254 |
| 5,102,171 | A * | 4/1992 | Saetre | 283/117 |
| 5,799,423 | A * | 9/1998 | Malino | 40/107 |
| 5,916,650 | A | 6/1999 | Rosenbaum et al. | |

OTHER PUBLICATIONS

USA Magnetic Puzzle Map, play-n-learn fun with interactive playboard, metal display board,1 page, believed to have been available before May 9, 2010.

USA Map, Ata-Buy, Inc., Hit the Road, product No. 19227MX, believed to have been available before May 9, 2010, 1 page.

USA Map, Magnetic Collectors Map, believed to have been available before May 9, 2010, 1 page.

USA Map, Souvenir Statements, 50 State Magnets, believed to have been available before May 9, 2010, 1 page.

USA Map, Metal Display Board, State-Shaped Magnets, CRW Flags Store in Glen Burnie, Maryland, dated Jan. 24, 2012, http://www.crwflags.com/page0142.html, 1 page.

USA Map, Metal Display Board, Fridge Door Mail, Inc., dated Jan. 24, 2012, http://www.fridgedoor.com/mausapumap.html, 1 page.

Picture of USA Map, Magnet Map, Ft. Worth Texas, believed to have been available before May 9, 2010, www.magnetletters.com, 1 page.

Picture of USA Map, Magnetic Material-sheeting Display Board, dated Jan. 24, 2012, www.magnetletters.com/USA_magnetic_states_maps.htm, 2 pages.

Metal Display Board, State Magnets Metal Collector's Board, dated Jan. 24, 2012, www.internationalgiftitems.com, 3 pages.

Metal Display Board, Magnetic Collectors Map, dated Jan. 24, 2012, www.walldrug.com/p-1689-magnetic-collectors-map.aspx, 2 pages.

* cited by examiner

*Primary Examiner* — Joanne Silbermann

(57) ABSTRACT

Apparatus and associated methods involve a system to electrostatically mount a display system with a number of visible indicators that define regions and magnetically mount a number of tokens that correspond to the defined regions. In an illustrative example, the display system may include a flexible vinyl carrier of between 0.004 and 0.010 inches which may be sufficient thickness to facilitate removal of air bubbles but sufficiently thin to support magnetic tokens on a wide variety of target surfaces. One surface of the carrier may provide a retention force generated by electrostatic forces between the first surface and a target surface. In an example implementation, the target surface may be the exterior of a residential appliance. An opposite surface of the carrier may include visible indicia, for example, of a map.

16 Claims, 4 Drawing Sheets

ELECTROSTATICALLY MOUNTED DISPLAY SYSTEM FOR MAGNETIC TOKENS

TECHNICAL FIELD

Various embodiments relate generally to methods and apparatus involving electrostatically mounted display systems for magnetic tokens.

BACKGROUND

Maps can be an educational tool for learning about geography, history, and culture. Maps can be found in books or globes, for example. More recently, maps have become readily available via computer workstations or even handheld mobile devices.

For school age children who may want or need to learn geography, access to information on maps may be relatively inaccessible. School age children may have limited access to map information unless they are permitted and able to access the Internet or other appropriate software, which may require significant guidance or investment of time and money on the part of an adult.

One fun and effective way to expose learn geography may be by taking a family trip by rail, car, or bus, for example. However, actual trips require substantial investments in time, money, and other expenses, so many may only be able to visit a limited number of destinations.

SUMMARY

Apparatus and associated methods involve a system to electrostatically mount a display system with a number of visible indicators that define regions and magnetically mount a number of tokens that correspond to the defined regions. In an illustrative example, the display system may include a flexible vinyl carrier of between 0.004 and 0.010 inches which may be sufficient thickness to facilitate removal of air bubbles but sufficiently thin to support magnetic tokens on a wide variety of target surfaces. One surface of the carrier may provide a retention force generated by electrostatic forces between the first surface and a target surface. In an example implementation, the target surface may be the exterior of a residential appliance. An opposite surface of the carrier may include visible indicia, for example, of a map.

In some examples, magnetic tokens may correspond to the countries or states of the map, and be releasably magnetically mounted in registration with the corresponding regions when the carrier is electrostatically mounted to the target surface.

Various embodiments may achieve one or more advantages. For example, some embodiments may advantageously provide an educational tool that may be readily accessible to all family members by mounting on a residential appliance, such as a refrigerator or dishwasher. Various implementations may provide reliable mounting to the target surface by providing both good electrostatic coupling for the carrier and reliable magnetic coupling for the tokens. For example, various embodiments may include a vinyl carrier with a thickness between 0.004 inches and less than 0.010 inches. Some carriers in this thickness range may be sufficiently thick to facilitate rapid removal of air bubbles by smoothing the carrier while it is in contact with the target surface, yet sufficiently thin so that the weight of the carrier can be reliably supported by the electrostatic forces between the carrier and the target surface, which may be substantially vertical, for example. In some embodiments, the carrier may be sufficiently thin to provide more reliable attachment of the magnetic tokens by providing a shortened flux path. In some embodiments, the carrier may be flexible enough to be easily rolled up for storage in a tubular container, which may also contain one or more magnetic tokens, for example. In various embodiments, the carrier may easily be repeatedly removed from a target surface and repositioned on the same or another target surface without involving adhesive or adhesive residue.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
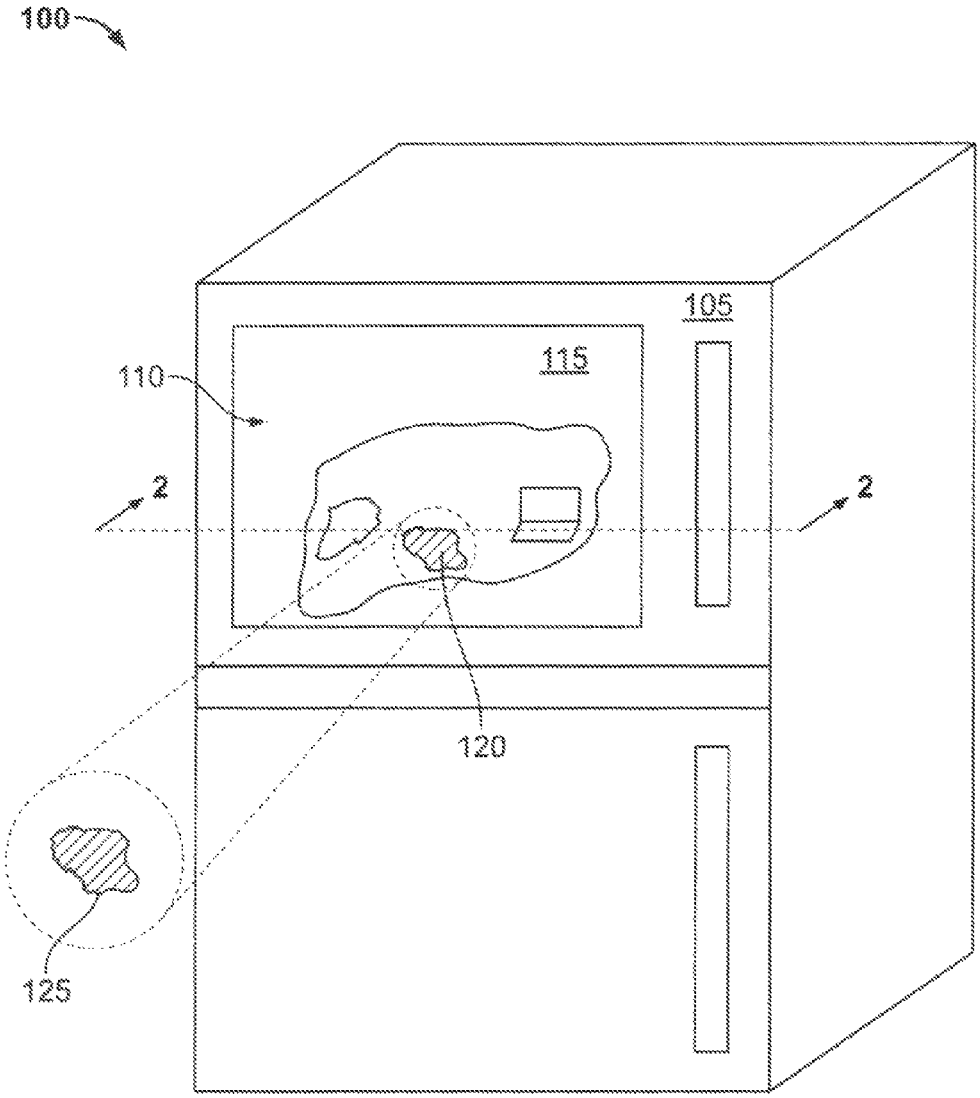
FIG. 1 depicts an exemplary electrostatically mounted display system on an appliance.

FIG. 1 depicts an exemplary electrostatically mounted display system on an appliance. In the depicted example, a residential appliance 100 has a front door with an exterior surface 105. On the exterior surface 105 is mounted an exemplary display system 110 that includes a flexible vinyl carrier 115 that displays information in the form of indicia 120. The carrier 115 is coupled to the exterior 105 by electrostatic forces. The indicia 120 visible on the carrier 115 define a region that corresponds to a shape of a magnetic token 125. The magnetic token may be mounted to the carrier 115 by reluctance forces associated with a magnetic field generated by magnetized material on the magnetic token 125. In an illustrative example, the magnetic token 125 may be registered to the position and orientation of the corresponding region defined by the indicia 120.

In various implementations, the appliance 100 may be a structure with a substantially flat target surface to which the display system 110 may be mounted. In some examples, the substantially flat surface of the appliance 100 may be planar, such as a door panel or side panel of a freezer, dish washer, file cabinet, desk, clothes dryer, garbage disposal, or the like. In some other examples, the substantially flat target surface may be at least partially curvilinear (e.g., substantially convex, concave) around a single axis (e.g., like a cylinder). The flexible vinyl carrier may substantially conform to appropriate curvilinear surfaces and provide sufficient electrostatic coupling force to maintain its mounting position until removed by a user.

Figure 2:
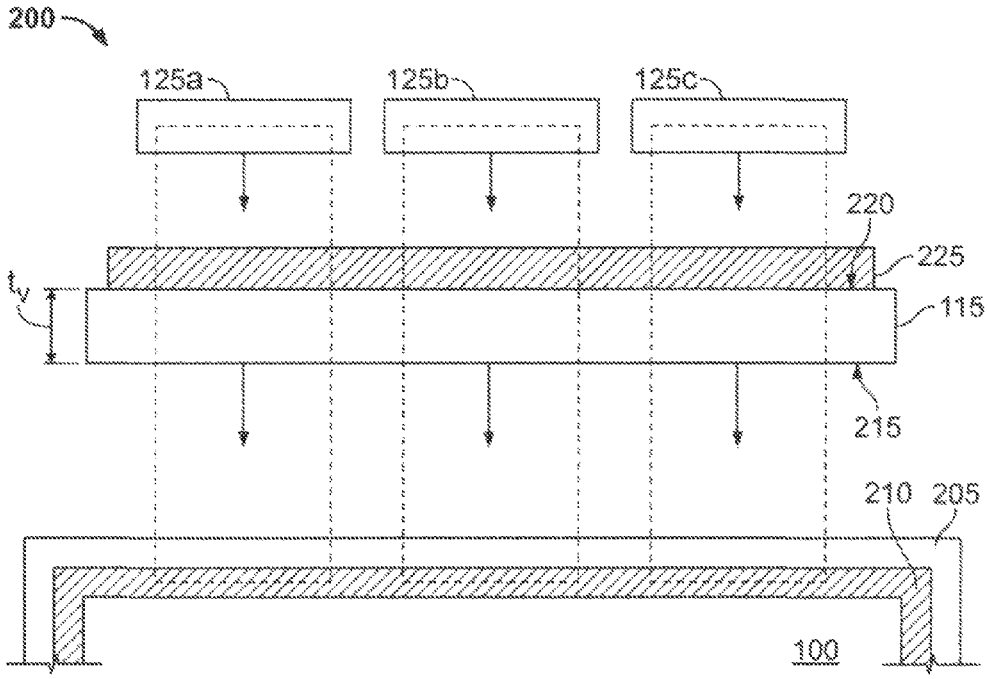
FIG. 2 depicts a cross-sectional view of an exemplary display system prior to mounting.

FIG. 2 depicts a cross-sectional view of an exemplary display system prior to mounting. In the depicted figure, the display system 200 is positioned to be mounted to the appliance 100 by electrostatic forces. The display system 200 includes the magnetic tokens 125*a*, 125*b*, 125*c*, each of which may be aligned in registration with corresponding indicia (not shown) on the carrier 115.

In this example, the appliance 100 is adapted to support the display system 200. In particular, the appliance 100 includes an outer dielectric layer 205 that may be substantially non-conductive. The surface 205 may be painted, coated, or otherwise treated (e.g., oxidized) with a film or layer of a substantially insulative substance, which may advantageously promote electrostatic adhesion to the carrier 115. The appliance 100 further includes a magnetically permeable layer 210. The layer 210 may include a material (e.g., ferrite, iron, steel) with a relative magnetic permeability substantially higher than one. By way of example, the relative magnetic permeability may between three and about eighty, or between at least eighty and one thousand, or between at least eight hundred and ten thousand. In another embodiment, the layer 210 of the appliance 100 may include a magnetic field generator. For example, the layer 210 could include one or more permanent magnet structures that may couple to attract the tokens 125*a*-125. In some embodiments, the layers 205, 210 may be overlapping or intermixed into a single layer.

The carrier 115 has a first major surface 215 for making intimate contact with the surface 205 on the appliance 100. As the surface 215 is brought into contact with the surface 205, electrostatic forces may be generated to attract the carrier 115 to the appliance 100. On its opposite side, the carrier 115 has a second major surface 220. In the depicted example, the indicia are implemented on a layer 225 on the surface 220. For example, the indicia layer 225 may be printed or otherwise deposited on the surface 220. The indicia may be formed of inks or paints, for example. By way of example and not limitation, various embodiments may advantageously be formed by hot stamping, foil stamping, silk screening, imprinting, engraving, manipulation by laser, thermal printing, or by one or more of these techniques, alone or in combination. In some embodiments, the indicia may be formed at least partially embedded within the carrier 115, such as by laser inscription or embossing, for example.

The thickness (tv) of the carrier 115 may preferably be between at least 0.004 inches and 0.010 inches (i.e., 4.0 mils-10.0 mils). In various embodiments, the carrier may be formed of a vinyl material with a substantially uniform thickness. In various embodiments, the thickness tv may be about 4.0, 4.5, 5.0, 5.5, 6.0, 6.5, 7.0, 7.5, 8.0, 8.5, 9.0, 9.5, or up to 10.0 mils. For example, various embodiments may have tv of about 0.0065 inches, such as in the range of between 0.004 inches and 0.010 inches, or between 0.0045 inches and 0.009 inches, or about 0.005 inches and 0.008 inches, or between 0.006 inches and 0.007 inches. In various embodiments, the carrier may be a sheet of at least 380 square inches, such as between about 430 and 450 square inches. In some embodiments, the carrier may be formed of a sheet having one dimension of at least 17.5 to 20 inches, and the other dimension of at least 22 to 26 inches. In one exemplary embodiment, a carrier sheet may have dimensions of about 18 inches by 24 inches.

Figure 3:
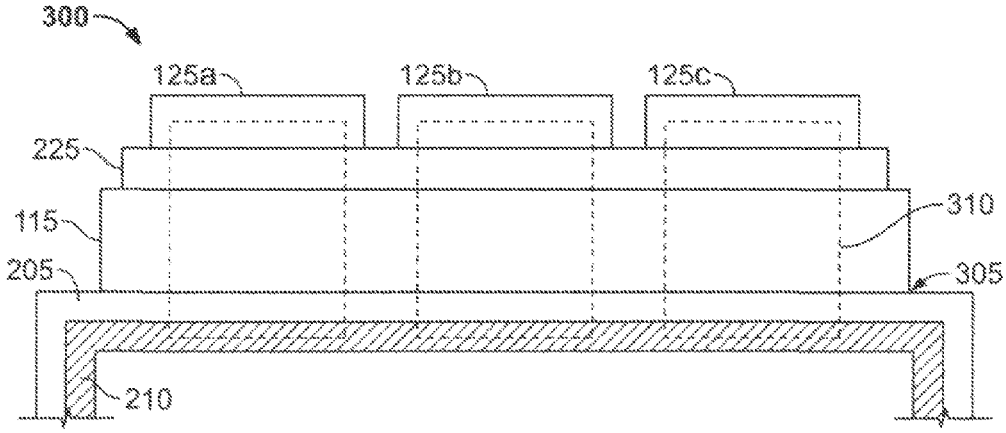
FIG. 3 depicts a cross-sectional view of the exemplary display system of FIG. 2 after mounting.

FIG. 3 depicts a cross-sectional view of the exemplary display system of FIG. 2 after mounting. The magnetic tokens 125*a*-125*c* may be registered in alignment with their respective corresponding indicia visible in the layer 225. Electrostatic forces (e.g., so-called static cling) along an interface 305 between surfaces 205, 215 may support the weight of the display system so that the carrier 115 may be maintained in position even if the appliance surface 205 is oriented substantially vertically. Magnetic forces (e.g., reluctance forces) indicated by a flux path 310 may support the weight of the respective tokens so that the tokens 125*a*-*c* are maintained in registration even if the appliance surface 205 is oriented substantially vertically. Various embodiments may be operable while the interface 305 is substantially free of adhesive compounds.

Figure 4:
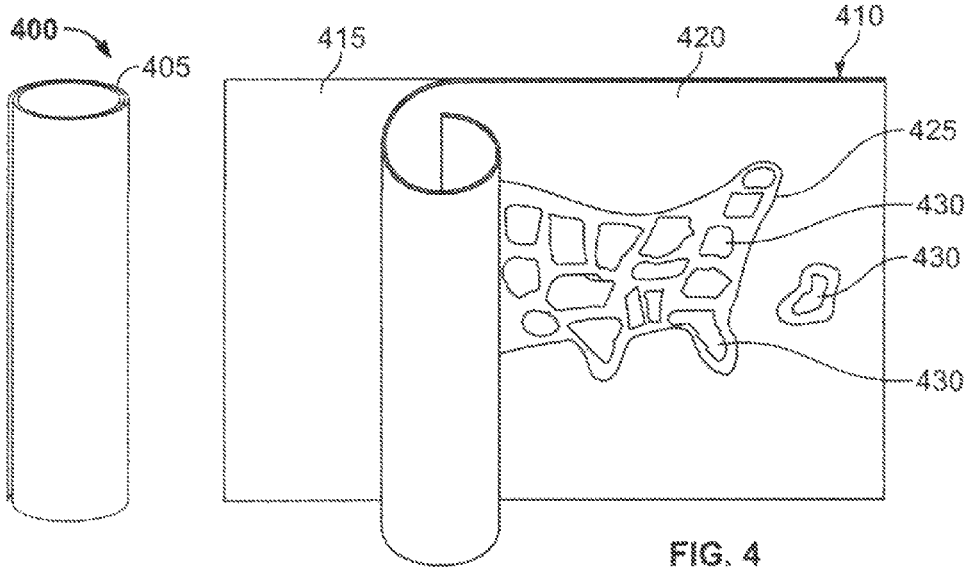
FIG. 4 is a perspective view of an exemplary flexible vinyl carrier partially removed from a backing.

FIG. 4 is a perspective view of an exemplary flexible vinyl carrier partially removed from a backing. A kit 400 includes a tubular container 405 capable of storing a display system 410 in a rolled up arrangement. The display system 410 includes a backing 415 and a flexible vinyl carrier 420. The backing 415 and carrier 420 are flexible and can be rolled or unrolled. By way of example and not limitation, the backing 415 may have a thickness of about 3 mils, for example, such as between 1 and 12 mils.

The flexible vinyl carrier 420 includes indicia 425 and a number of regions 430 defined by indicia. Tokens corresponding to each region may be registered in alignment with each defined region. In various examples, the defined regions may represent geographical areas. In some embodiments, the defined regions may represent anatomical features of a plant, insect, or animal, for example.

The kit 400 may be packaged with one or more magnetic tokens that are shaped to substantially correspond to the regions 430. The display system 410 may be rolled up and stored, along with any available magnetic tokens, in the tubular container 405.

Figure 5:
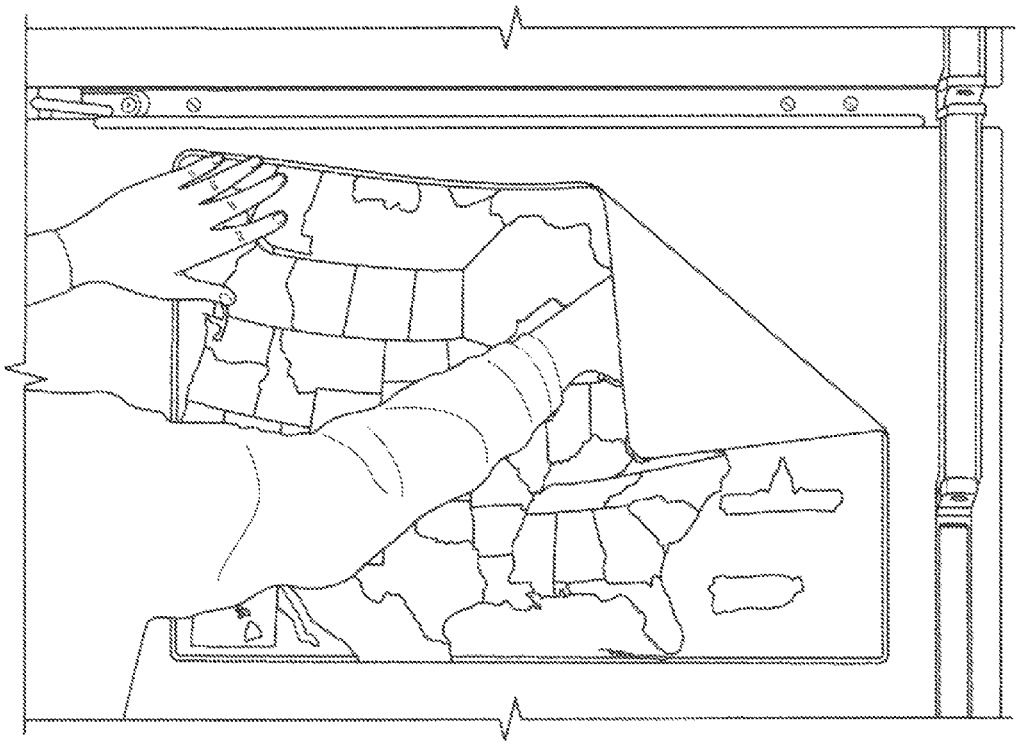
FIG. 5 is a plan view of an exemplary carrier being mounted to a target surface with manual smoothing to reduce air pockets.

FIG. 5 is a plan view of an exemplary carrier being mounted to a target surface with manual smoothing to reduce air pockets. In the depicted example, the target surface appears substantially flat, although the surface need not be substantially smooth. In addition, some embodiments may be operable to mount a display system with a target surface that may be curvilinear (e.g., inner or outer surface of a cylinder) in one of the dimension. Some embodiments may be mountable to a sufficiently large target surface that may have two dimensional curvature (e.g., inner or outer surface of a sphere).

Figure 6:
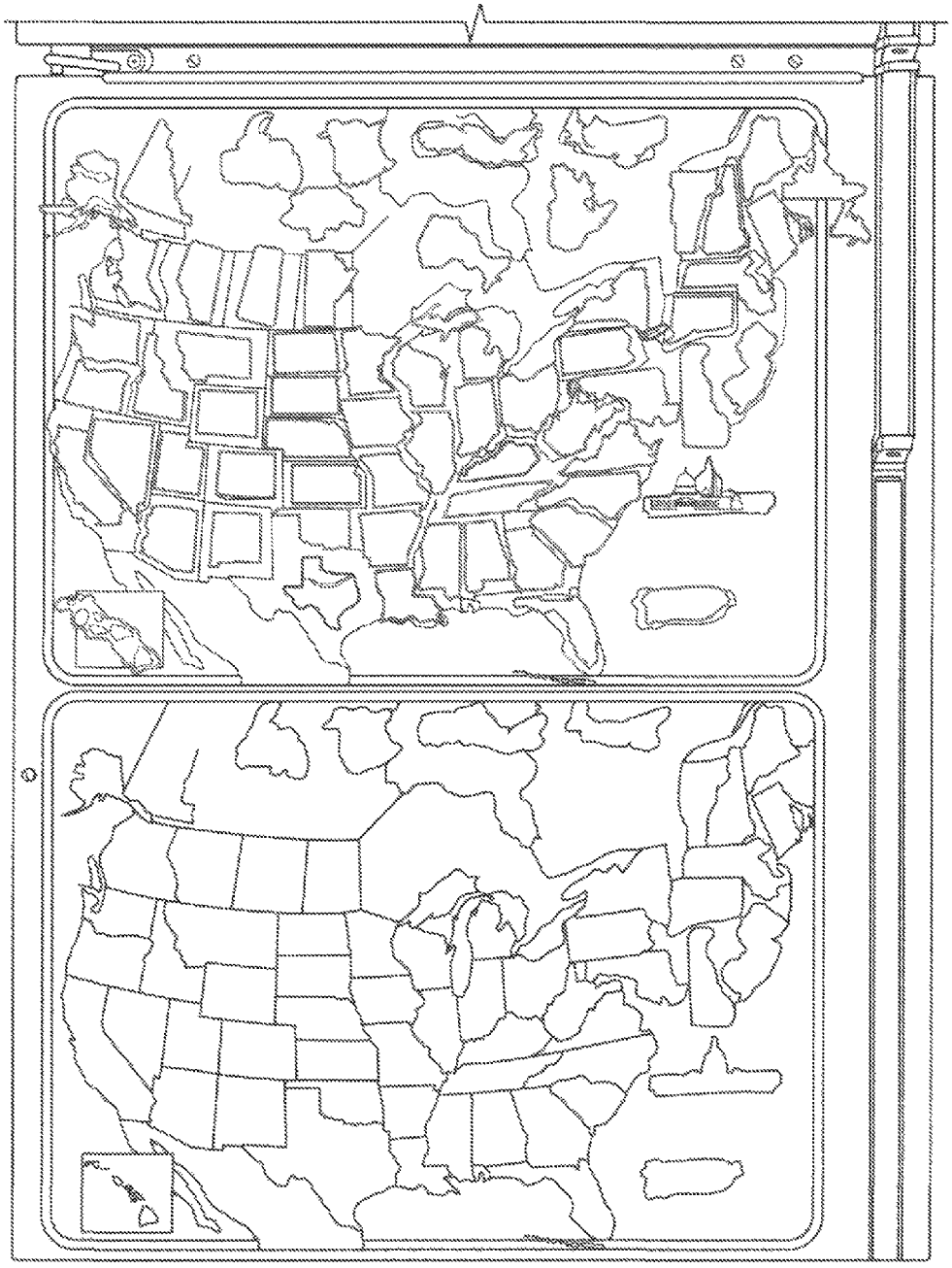
FIG. 6 is a front view of a residential appliance with two exemplary display systems, one being populated with magnetic tokens and the other being unpopulated.

FIG. 6 is a front view of a residential appliance with two exemplary display systems, one being populated with magnetic tokens and the other being unpopulated.

In the depicted example, the indicia is a map of North America, including the states of the U.S. and Canada. The small states are magnified to a minimum size suitable for providing educational information on each magnet. Each predefined region corresponds to one of the 50 United States, or territories in Canada.

Although various embodiments have been described with reference to the figures, other embodiments are possible. For example, some embodiments may include indicia arranged as a representation of another geographical region, such as the member states of the European Union.

Some embodiments may include a transparent laminate film. In some implementations, the additional film layer may provide protection to substantially resist abrasion or deterioration of the indicia by the installation and movement of the magnetic tokens.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A reconfigurable token display system mountable to a target surface, the system comprising:

a flexible carrier substrate comprising a vinyl film sheet formed as a planar film having a substantially uniform thickness;

a first surface on a major side of the carrier substrate, the first surface providing an electrostatic retention force sufficient to maintain the carrier substrate on a target surface when the first surface is adjacent to and in substantial contact with a dielectric layer of the substantially flat target surface;

a second surface on a major side of the carrier substrate opposite the first surface, the second surface comprising visible indicia that define a plurality of uniquely-shaped regions; and, a plurality of magnetic tokens each being uniquely shaped so that there is a one to one correspondence between each of the plurality of magnetic tokens and one of the plurality of defined regions, wherein the carrier substrate repeatedly and releasably mounts to at least one substantially flat target surface.

2. The system of claim 1, wherein each of the at least one magnetic tokens comprises a static magnetic field generator operable to maintain the token in registration with the corresponding region when the carrier substrate is electrostatically mounted to the target surface.

3. The system of claim 2, wherein each of the at least one magnet tokens further comprises indicia containing information associated with the defined region to which each magnetic token corresponds.

4. The system of claim 1, wherein said substantially uniform thickness of the carrier substrate is a value between 0.004 inches and 0.010 inches.

5. The system of claim 1, wherein substantially uniform thickness of the carrier substrate is a value between 0.0045 inches and 0.009 inches.

6. The system of claim 1, wherein substantially uniform thickness of the carrier substrate is a value between 0.005 inches and 0.008 inches.

7. The system of claim 1, wherein substantially uniform thickness of the carrier substrate is a value between 0.006 inches and 0.007 inches.

8. The system of claim 1, wherein the first surface is substantially free of adhesive materials.

9. The system of claim 1, wherein the target surface comprises at least a partially dielectric layer disposed between the first surface of the carrier substrate and a layer with a relative magnetic permeability substantially greater than unity.

10. The system of claim 1, wherein each magnetic token is adapted to be releasably attached to the carrier substrate mounted on the target surface by a retention force associated with a path for magnetic flux passing through the target surface, wherein at least a portion of said flux passing through the target surface passes through material having a relative magnetic permeability substantially above one.

11. The system of claim 10, wherein said relative magnetic permeability is between three and about eighty.

12. The system of claim 10, wherein said relative magnetic permeability is between at least eighty and one thousand.

13. The system of claim 10, wherein said relative magnetic permeability is between at least eight hundred and ten thousand.

14. The system of claim 1 wherein the carrier substrate is substantially flexible.

15. The system of claim 1, wherein the carrier substrate is rolled into a substantially cylindrical form.

16. The system of claim 1, further comprising a backing sheet releasable from the first surface of the carrier substrate prior to mounting to the target surface.

* * * * *